US005728672A

United States Patent [19]

Richter

[11] Patent Number: 5,728,672

[45] **Date of Patent: *Mar. 17, 1998**

[54] PINE OIL HARD SURFACE CLEANING COMPOSITIONS

[75] Inventor: Alan F. Richter, Branchburg, N.J.

[73] Assignee: Reckitt & Colman Inc., Montvale, N.J.

[ * ] Notice: The term of this patent shall not extend beyond the expiration date of Pat. No. 5,591,708.

[21] Appl. No.: 690,106

[22] Filed: Aug. 1, 1996

Related U.S. Application Data

[63] Continuation-in-part of Ser. No. 523,413, Sep. 5, 1995, Pat. No. 5,591,708.

[30] Foreign Application Priority Data

Aug. 4, 1995 [GB] United Kingdom ..... 9516072

[51] Int. Cl.[6] ..... C11D 1/835; C11D 3/26; C11D 7/50; C11D 3/48

[52] U.S. Cl. ..... 510/463; 510/504; 510/423; 510/384

[58] Field of Search ..... 510/463, 384, 510/423, 504

[56] References Cited

U.S. PATENT DOCUMENTS 4,048,121 9/1977 Chang ..... 252/527

FOREIGN PATENT DOCUMENTS 1 153 267 of 1981 Canada .
1120820 3/1982 Canada .
0 086 493 A1 8/1983 European Pat. Off. .
0 268 873 A2 6/1988 European Pat. Off. .
0 288 689 A2 11/1988 European Pat. Off. .
0 358 474 A2 3/1990 European Pat. Off. .
0 651 048 A2 5/1995 European Pat. Off. .
23 49 323 4/1975 Germany .
1 592 203 7/1981 United Kingdom .

OTHER PUBLICATIONS

Copy of PCT International Search Report dated 12 Dec. 1996 for Application No. PCT/US 96/12613.

Copy of GB Patent Office Search Report dated 8 Nov. 1996 for Application No. GB 9616439.7.

*Primary Examiner*—Paul Lieberman
*Assistant Examiner*—Charles Boyer
*Attorney, Agent, or Firm*—Fish & Richardson P.C.

[57] ABSTRACT

A pine oil cleaning concentrate composition comprising as essential constituents: pine oil, a nonionic surfactant with a cloud point of 20° C. or less, a solubilizing agent and, water, feature reduced levels of volatile organic contents, including reduced amounts of pine oil, yet provides good blooming characteristics upon mixing of the concentrate composition with a further amount of water to produce a cleaning composition therefrom. The pine oil cleaning compositions may further include conventional additives, including germicidal agents, viscosity modification agents, fragrances (natural or synthetically produced), foaming agents, further surfactants, and coloring agents.

11 Claims, No Drawings

PINE OIL HARD SURFACE CLEANING COMPOSITIONS

This application is a continuation-in-part application of copending application U.S. Ser. No. 08/523,413 filed on 5 Sep. 1995, now U.S. Pat. No. 5,591,708.

The present invention relates to improvements in cleaning compositions. More particularly, the present invention is directed to improved cleaning compositions and concentrates thereof, which find particular use in hard surface cleaning applications.

Cleaning compositions are commercially important products and enjoy a wide field of utility in assisting in the removal of dirt and grime from surfaces, especially those characterized as useful with "hard surfaces". One particular category of cleaning compositions are those which are classed as pine oil type cleaning compostions which typically include one or more of the following identifying characteristics: containing an mount of one or more resins or oils derived from coniferous species of trees; containing synthetic fragrance compositions which are intended to mimic the scent of of one or more resins or oils derived from coniferous species of trees; a color ranging from colorless to a deep amber, deep amber yellow or deep amber reddish color; generation of a milky or cloudy appearance when diluted with water in dilutions useful for cleaning applications.

While such pine oil type cleaning compositions are commercially significant and in popular use, their use is not without attendant shortcomings. For example, high levels of pine oil in a cleaning composition are known to leave undesirable surface residues, particularly on hard surfaces, where the pine oil form a constituent in a cleaning composition. This effect may be minimized by the addition of further constituents, such as the use of certain surfactants which are useful in solubilizing and stabilizing the the pine oil. However, such a solution raises further problems as many useful surfactants, and frequently the pine oil itself, are categorized as undesired volatile organic compounds ("VOC"). Thus, there is need in the art for providing improved pine oil type cleaning compositions which exhibit one or more of the identifying characteristics outlined above which are important indicia for consumer acceptance, while at the same time providing a reduction in the content of undesired volatile organic compounds which are often used in commercially available pine oil type cleaning compositions. Various formulations directed to the production of pine oil type cleaners with reduced pine oil content have been proposed. For example, CA 1153267 teaches a pine oil type cleaning composition which includes 0 to 8% by weight pine oil, but which also requires that a minimum of 5.6% by weight alpha terpineol be present. Further, CA 1120820 describes disinfecting pine oil type cleaning composition which includes among other essential constituents, from 5 to 30 % by weight of pine oil. While advantageous, these compositions as well as other art known compostions and formulations are not without attendant shortcomings, certain shortcomings which the present applicant addresses.

It is therefore among the objects of the invention to provide a cleaning compositions and concentrates thereof which exhibit one or more of the identifying characteristics of pine oil type cleaning compositions described above, particularly those which exhibit reduced amounts of volatile organic compounds("VOCs").

It is further object of the invention to provide commercially acceptable shelf stable Concentrated cleaning compositions which exhibit one or more of the identifying characteristics of pine oil type cleaning compositions described above, particularly those which exhibit reduced amounts of VOCs, which concentrated cleaning compositions are readily dilutable with water to form useful cleaning compositions. Such cleaning compositions are especially useful for cleaning hard surfaces.

A still further object of the invention is the provision of cleaning compositions and concentrates which exhibit one or more of the identifying characteristics of pine oil type cleaning compositions described above, particularly those which exhibit reduced amounts of volatile organic compounds, which composition further include one or more constituents which impart disinfectant properties to the cleaning compositions.

A yet further object of the invention is the provision of pourable concentrated cleaning compositions exhibiting one or more of the identifying characteristics of pine oil type cleaning compositions described above which are readily dilutable in water.

A still further object of the invention is to provide a process for cleaning and disinfecting a hard surface requiring such treatment which process includes the step of applying a cleaning composition in amounts effective for providing such cleaning and disinfecting effects.

These and other objects of the invention will become apparent to from the following detailed description of the invention.

The compositions according to the invention comprise the following constituents:

A) pine oil;

B) a nonionic surfactant with a cloud point of 20° C. or less;

C) solubilizing agent; and,

D) water.

Compositions according to the invention may optionally comprise further conventional additives, including but not limited to: further surface active agents, germicidal agents, fragrances and coloring agents, as well as other additives known to the art.

Constituent A)

Compositions according to the invention comprise a pine oil constituent. Pine oil is a complex blend of oils, alcohols, acids, esters, aldehydes and other organic compounds. These include terpenes which include a large number of related alcohols or ketones. Some important constituents include terpineol, which is one of three isomeric alcohols having the basic molecular formula $C_{10}H_{17}OH$. One type of pine oil, synthetic pine oil, will generally have a specific gravity, at 15.5° C. of about 0.9300, which is lower than the two other grades of pine oil, namely steam distilled and sulfate pine oils, and will generally contain a higher content of turpentine alcohols. Other important compounds include alpha- and beta-pinene (turpentine), abietic acid (rosin), and other isoprene derivatives.

Particularly effective pine oils which are presently commercially available include Unipine® 60 (from Union Camp, which is believed to contain approximately 60% terpene alcohols), Unipine® S-70 and Unipine® S-70 (from Union Camp, both are believed to contain approximately 70% terpene alcohols), Unipine® S and Unipine® 80 (from Union Camp, both are believed to contain approximately 80% terpene alcohols), Unipine® 80 (from Union Camp, which is believed to contain approximately 80% terpene alcohols), Unipine® 85 (from Union Camp, which is believed to contain approximately 85% terpene alcohols), Unipine® 90 (from Union Camp, which is believed to contain approximately 90% terpene alcohols), as well as Alpha Terpineol 90 (from Union Camp, which is believed to contain approximately 100% terpene alcohols). Further effective pine oils include Glidco® Pine Oil™ 60 (available from Glidco Organics Corp., Jacksonville, Fla., believed to contain approximately 60% terpene alcohols), Glidco® Pine Oil 60 (available from Glidco Organics Corp., Jacksonville, Fla., believed to contain approximately 60% terpene alcohols); Glidco® Pine Oil 140 (available from Glidco Organics Corp., Jacksonville, Fla., believed to contain approximately 70% terpene alcohols); Glidco® Pine Oil 80 (available from Glidco Organics Corp., Jacksonville, Fla., believed to contain approximately 80% terpene alcohols) Glidco® Pine Oil 150 (available from Glidco Organics Corp., Jacksonville, Fla., believed to contain approximately 85% terpene alcohols); Glidco® Terpene SW (available from Glidco Organics Corp., Jacksonville, Fla., believed to contain approximately 75% terpene alcohols); as well as Glidco® Terpineol 350 (available from Glidco Organics Corp., Jacksonville, Fla., believed to contain approximately 100% terpene alcohols). Other products which can contain up to 100% pure alpha-terpineol, may also be used in the present invention.

The pine oil constituent may be present in the concentrate compostions in amounts of up to about 5% by weight, preferably in amounts of 0.1 and 4% by weight, but most preferably in amount of between 2 and 4% by weight.

Constituent B)

The compositions of the present invention also include as a necessary constituent a nonionic surface active agent which exhibits a cloud point of 20° C. or less. Suitable nonionic surface active agents include condensation products of one or more alkylene oxide groups with an organic hydrophobic compound, such as an aliphatic or alkyl aromatic compound. Suitable nonionic surface active agents include surfactant compositions based upon polyethoxylated, polypropxylated, or polyglycerolated alcohols or alkylphenols or fatty acids.

One exemplary class of nonionic surfactants which finds use are alkoxylated alcohols especially alkoxylated fatty alcohols. These include ethoxylated and propoxylated fatty alcohols, as well as ethoxylated and propoxylated alkyl phenols, having both with alkyl chains of about 7–16, more preferably about 8–13 carbon chains in length.

Exemplary alkoxylated alcohols include certain ethoxylated alcohol compositions presently commercially available from the Shell Chemical Company, (Houston, Tex.) under the general trade name Neodol®, which are described to be linear alcohol ethoxylates. Of these, those exhibiting a cloud point of 20° C. or less may be used. Specific compositions include: Neodol® 91-2.5 which is described as an ethoxylated alcohol having an average molar ratio of 2.7:1 ethoxy groups/alcohol groups per molecule; a molecular weight of 281, and a cloud point in water of 20° C. and less; Neodol® 23-3 which is described as an ethoxylated alcohol having an average molar ratio of 2.9:11 ethoxy groups/alcohol groups per molecule; a molecular weight of 322, and a cloud point in water of 20° C. and less.

Exemplary alkoxylated alcohols further include certain compositions presently commercially available from the Union Carbide Co., (Danbury, Conn.) under the general trade name Tergitol®, which are described to be secondary alcohol ethoxylates. Again, those exhibiting a cloud point of 20° C. and less may be used. Specific compositions include: Tergitol® 15-S-3 which is described as an ethoxylated secondary alcohol having an average molar ratio of 3.2:1 ethoxy groups/alcohol groups per molecule, and a cloud point in water of less than 20° C.; Tergitol® 15-S-5 which is described to be an ethoxylated secondary alcohol having an average molar ratio of 5:1 ethoxy groups/alcohol groups per molecule, and a cloud point in water of less than 20° C.

Exemplary alkoxylated alkyl phenols include certain compositions presently commercially available from the Rhône-Poulenc Co., (Cranbury, N.J.) under the general trade name Igepal®, which are described to be octyl and nonyl phenols. Again, those exhibiting a cloud point of 20° C. or less may be used. Specific compositions include: Igepal® CA-210 which is described as an ethoxylated octyl phenol having an average of 1.5 ethoxy groups groups per molecule and a cloud point in water of less than 20° C. and, Igepal® CA-420 which is described as an ethoxylated octyl phenol having an average of 3 ethoxy groups groups per molecule and a cloud point in water of less than 20° C.

Of course, a mixture of two or more surface active agents having a cloud point of 20° C. or less may be incorporated into the inventive compositions. Other known nonionic surface active agents not particularly enumerated here may also be used. Such exemplary nonionic surface active agents are described in *McCutcheon's Detergents and Emulsifiers*, North American Edition, 1982; *Kirk-Othmer, Encyclopedia of Chemical Technology,* 3rd Ed., Vol. 22, pp. 346–387, the contents of which are herein incorporated by reference.

It is contemplated that one or more nonionic surfactants which are characterized in exhibiting a cloud point of 20° C. or less may also be used as the sole blooming agent in an aqueous hard surface cleaning and/or disinfecting composition, i.e., absent the pine oil discussed herein.

The cloud point of Constituent B of the present invention may be determined by known methods. For example, ASTM D2024 (reapproved 1986) for "Standard Test method for Cloud Point of Nonionic Surfactants". According to this test method which is particularly useful for nonionic surfactants of a detergent systems which are characterized of less soluble in water at higher temperatures than at lower temperatures wherein the cloud point occurs within water at a temperature range of between 30°–95° C. According the test protocol, a one percent test solution is prepared by weighing one gram of the surfactant into a 150 ml. beaker to which 100 mls. of distilled dimineralized water at a temperature of less than 30° C. is added. The sample is agitated until solution is reached, after which a 50 ml. aliquot of the solution is placed into a test tube. While agitating the sample solutions slowly with the thermometer, the test tube is heated with a bunsen burner until the sample solution becomes definitely cloudy, at which point it is removed from the heat. While stirring with the thermometer continues, the test tube and its sample solution are allowed to cool slowly until the sample solution clarifies at which point the temperature is noted. Such a test method provides a simple, yet reliable, means for determining the cloud point of a surfactant in water.

An even simpler test method for effectively determining which nonionic surfactants may be used in the compositions of the invention is as follows: to a clean beaker or other glass vessel is added 99 parts by weight of deionized water at 20° C.±0.5° C., and 1 part by weight (by weight of the actives) of a surfactant composition to be tested. This test sample is stirred and the temperature permitted to drop to 20° C.; if this test sample is observed to be murky or cloudy in appearance as the test sample's temperature achieves 20° C. and drops below 20° C., it is considered to have a suitable cloud point of 20° C. and less and may be used as Constituent B in the concentrate compositions according to the invention.

Constituent B) may be present in any effective amount, but desirably is present in the concentrate compostions in amounts of up to about 10% by weight, preferably in amounts of 0.1 and 6% by weight, but most preferably in amount of between 4 and 6% by weight.

Constituent C)

As a further essential consituent, there is an included an effective amount of at least one solubilizing agent effective in enhancing the miscibility of the pine oil constituent in water. Exemplary solubilizing agents include, but are not limited to lower alkyl alcohols, especially $C_1$–$C_8$ alcohols, preferably methanol, ethanol, propanol and isopropanol. Further exemplary solubilizing agents include lower alkyl glycols and lower alkylene glycols, especially those containing from 1 to 8 carbon atoms.

The present inventors have found that the addition of a solubilizing agent provides the benefit of improving the solubility of the pine oil consitutent in aqueous concentrate compositions and also provides a clarifying effect upon said compositions, enhancing their appearance to the consumer. Also, the addition of the solubilizing agent provides the further benefit of enhancing the shelf stability of concentrate compositions which is a highly deskable feature particularly for such a consumer oriented product.

The inventors have surprisingly found however, that while the use of a solubilizing agent to improve the solubility of a pine oil consitutent in aqueous concentrate compositon may be known to the art, the use of a solubilizing agent in conjunction with the surface active agents according to Consitutent B, and further in conjunction with an optional but deskable nonionic surface active agents as described above, is not believed to be known. The inventors have also surprisingly found that excellent pine oil type concentrate compositions may be formed from these constituents, especially those including amounts of the further optional nonionic surface active agents, which feature identifying characteristics typical of pine oil type cleaning compostions, particularly a pronounced "blooming" effect when a cleaning composition is formed therefrom. Yet, these features are achieved with concentrate compostions which include substantially reduced amounts of pine oil, as well as include substantially reduced amounts of other VOCs as compared to known art compostions. While the use of further optional nonionic surface active agents is not essential for the "blooming" effect to occur, their incorporation is nonetheless frequently desirable for it added detersive and solubilizing effects.

The solubilizing agent may be present in any effective amount found to solubilize/stabilize the concentrate composition, but desirably is present in the concentrate compostions in amounts of up to about 15% by weight, preferably in amounts of 0.1 and 15% by weight, but most preferably in amount of between 5 and 15% by weight.

Optional Additives)

Compositions of the invention may optionally include one or more conventional additives known to be useful in pine oil type cleaning compositions including germicidal agents, viscosity modification agents, fragrances (natural or synthetically produced), foaming agents, water softening agents, further surfactants including anionic, cationic, nonionic, amphoteric and zwitterionic surface active agents, especially those useful in providing further detersive effects, and coloring agents. Such optional constituents should be selected so to have little or no detrimental effect upon the blooming behaviour provided by the inventive compostions, and generally the total weight of such further conventional additives may comprise up to 20% by weight of a concentrated composition formulation, but are preferably less.

An optional, but frequently desirable constituent which may be included in compositions according to the invention are germicidal agents, of which certain quarternary ammonium compounds are of particular use.

Examples of preferred cationic surfactant compositions useful in the practice of the instant invention include quarternary ammonium compounds and salts thereof include quarternary ammonium germicides which may be characterized by the general structural formula:

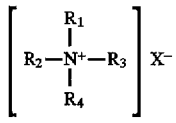

where at least one or $R_1$, $R_2$, $R_3$ and $R_4$ is a hydrophobic, aliphatic, aryl aliphatic or aliphatic aryl radical of from 6 to 26 carbon atoms, and the entire cation portion of the molecule has a molecular weight of at least 165. The hydrophobic radicals may be long-chain alkyl, long-chain alkoxy aryl, long-chain alkyl aryl, halogen-substituted long-chain alkyl aryl, long-chain alkyl phenoxy alkyl, aryl alkyl, etc. The remaining radicals on the nitrogen atoms other than the hydrophobic radicals are substituents of a hydrocarbon structure usually containing a total of no more than 12 carbon atoms. The radicals $R_1$, $R_2$, $R_3$ and $R_4$ may be straight chained or may be branched, but are preferably straight chained, and may include one or more amide or ester linkages. The radical X may be any salt-forming anionic radical.

Exemplary quarternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quarternary ammonium salts include those in which the molecule contains either amide or ester linkages such as octyl phenoxy ethoxy ethyl dimethyl benzyl ammonium chloride, N-(laurylcocoaminoformylmethyl)-pyridinium chloride, and the like. Other very effective types of quarternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quarternary ammonium compounds which act as germicides and which are be found useful in the practice of the present invention include those which have the structural formula:

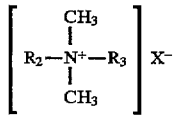

wherein $R_2$ and $R_3$ are the same or different $C_8$–$C_{12}$alkyl, or $R_2$ is $C_{12-16}$alkyl, $C_{8-18}$alkylethoxy, $C_{8-18}$alkylphenolethoxy and $R_3$ is benzyl, and X is a halide, for example chloride, bromide or iodide, or methosulfate. The alkyl groups recited in $R_2$ and $R_3$ may be straight chained or branched, but are preferably substantially linear.

Such quartenary germicides are usually sold as mixtures of two or more different quartenaries, such as BARDAC® 205M, (presently commercially available from Lonza, Inc., Fairlawn, N.J.) which is believed to be a 50% aqueous solution containing 20% by weight of an alkyl dimethyl benzylammonium chloride (50% C14, 40% C16 alkyl); 15% by weight of an octyl decyl dimethylammonium chloride; 7.5% by weight of dioctyl dimethylammonium chloride; and 7.5% by weight of didecyl dimethylammonium chloride. A further useful quarternary germicide is CYNCAL® 80% (presently commercially available from Hilton Davis Chemical Co., Cincinnati, Ohio) which is believed to comprise 80% by weight of an alkyl dimethyl benzylammonium chloride (50% C14, 40% C12 and 10% C16 alkyl), 10% water and 10% ethanol. Further useful quarternary germicidal agents include BTC-8358®, an alkyl benzyl dimethyl ammonium chloride (80% active) and BTC-818®, a dialkyl dimethyl ammonium chloride (both presently commercially available from the Stepan Chemical Co., Chicago, Ill.). Additional suitable commercially available quarternary ammonium germicides of the alkyl dimethyl benzylammonium chloride type containing the same alkyl dimethyl benzylammonium chloride mixture as that of CYNCAL® and which are generally referred to as quarternium salts include BARQUAT® MB-80, (presently commercially available from Lonza, Inc., Fairlawn, N.J.) which is believed to be and 80% by weight solution (20% ethanol) of the quarternary, HYAMINE® 1622 believed to be an aqueous solution of benzethonium chloride, and HYAMINE® 3500, which is believed to be a 50% aqueous solution of the quarternary (both presently commercially available from Lonza Inc., Fairlawn, N.J.).

Further optional germicidal agents include known art compositions and compounds, especially phenolic group containing compounds such as o-phenyl-phenol, o-benzyl [p-chlorophenol] and 4-tertamylphenol.

A further optional, but desirable constituent include fragrances, natural or synthtically produced containing synthetic fragrance compositions which are intended to mimic the scent of of one or more resins or oils derived from coniferous species of trees, viz., a scent characteristic of pine oil type cleaning concentrates. Such fragrances may be added in any conventional manner, admixing to a concentrate composition or blending with other constituents used to form a concentrate composition, in amounts which are found to be useful to enhance or impart the desired scent characteristic to the concentrate composition, and/or to cleaning compositions formed therefrom. Fragrance effects atypical of pine oil type cleaning concentrates may be used as well.

Further optional, but advantageously included constituents are one or more coloring agents which find use in modifying the appearance of the concentrate compositions and enhance their appearance from the perspective of a consumer or other end user. Known coloring agents, may be incorporated in the compostions in effective amount to improve or impart to concentrate compositions an appearance characteristic of a pine oil type concentrate composition, such as a color ranging from colorless to a deep amber, deep amber yellow or deep amber reddish color. Such a coloring agent or coloring agents may be added in any useful amount in a conventional fashion, i.e., admixing to a concentrate composition or blending with other constituents used to form a concentrate composition. However, other colors atypical of pine oil type cleaning concentrates may be used as well.

As an optional constituent, it is to be understood that the concentrate compositions of the invention may also include one or more surface active agents which may be an anionic, cationic, nonionic, amphoteric or zwitterionic surface active agents or surfactants which may be found useful in providing good dispersive properties, and or additional detersive properties to the compositions. Mixtures of one or more of these surface active agents may also be used. These classes of surface active agents are well known to the art and exemplary compositions are described in *McCutcheon's Detergents and Emulsifiers*, North American Edition, 1982; *Kirk-Othmer, Encyclopedia of Chemical Technology*, 3rd Ed., Vol. 22, pp. 346–387, the contents of which are herein incorporated by reference. Mixtures of two or more such surface active agents may be incorporated into the inventive compositions.

One class of surface active agents which may be used, include nonionic surfactant compostions, such as those which may be characterized as condensation products of alkylene oxide groups with an organic hydrophobic compound, such as an aliphatic or alkyl aromatic compounds. Such compounds include those which may be characterized as nonionic surfactants based on alkoxylated alcohols especially alkoxylate fatty alcohols, and alkoxylated alkyl phenols. These include ethoxylated and propoxylated fatty alcohols, as well as ethoxylated and propoxylated alkyl phenols, both with alkyl chains of about 7–16, more preferably about 8–13 carbon chains in length. Exemplary alkoxylated alcohols include certain linear alcohol ethoxylates presently commercially available under general trade name Neodol®, alkoxylated alkyl phenols including certain octyl and nonyl phenol compositions available under the tradename of Igepal®, secondary alcohol ethoxylates available under the general trade name Tergitol®.

The nonionic surface active agents which, as described here, may be further added to the nonionic surface active agent of Constituent B may be differentiated therefore as not required to exhibit a a cloud point of 20° C. and less, but rather are nonionic surface active agents which exhibit a cloud point greater than those of Constituent B, more preferably are those which exhibit a cloud point of at least 20° C., but most preferably are those which exhibit a cloud point in excess of 20° C. The addition of this further further nonionic surfactant to the concentrate compositions provides for an additional detersive action in the cleaning compositions produced from the product, acts as an assistant in solubilizing the Constituent B, while the higher cloud point characteristic is intended to ensure that this further nonionic surfactant will not produce an undue "blooming" effect upon the dilution of the concentrate with further water to form a cleaning composition therefrom.

Exemplary anionic surface active agents include compounds known to the art as useful as anionic surfactants. These include but are not limited to: alkali metal salts, ammonium salts, amine salts, aminoalcohol salts or the magnesium salts of one or more of the following compounds: alkyl sulfates, alkyl ether sulfates, alkylamidoether sulfates, alkylaryl polyether sulfates, monoglyceride sulfates, alkylsulfonates, alkylamide sulfonates, alkylarylsulfonates, olefinsulfonates, paraffin sulfonates, alkyl sulfosuccinates, alkyl ether sulfosuccinates, alkylamide sulfosuccinates, alkyl sulfosuccinamate, alkyl sulfoacetates, alkyl phosphates, alkyl ether phosphates, acyl sarconsinates, acyl isethionates, and N-acyl taurates. Generally, the alkyl or acyl radical in these various compounds comprise a carbon chain containing 12 to 20 carbon atoms.

A particular class of useful further surfactants include amphoteric betsine surfactant compounds which exhibit the following general formula:

$$R-\overset{(+)}{N}(R_1)_2-R_2\overset{(-)}{COO}$$

wherein R is a hydrophobic group selected from the group selected from alkyl groups containing from about 10 to about 22 carbon atoms, preferably from about 12 to about 18 carbon atoms, alkylaryl and arylalkyl groups containing a similar number of carbon atoms with a benzene ring being treated as equivalent to about 2 carbon atoms, and similar structures interrupted by amido or ether linkages; each $R_1$ is an alkyl group containing from 1 to about 3 carbon atoms; and $R_2$ is an alkylene group containing from 1 to about 6 carbon atoms.

One or more such betaine compounds may be added to the compositions of the invention in order to improve the detersive properties of the pine oil hard surface cleaning compositions provided within.

Examples of preferred betaines include lauramidopropyl betaine, a commercial preparation of which is available under the tradename Mirataine® BB (from Rhône-Poulenc, Cherry Hill, N.J.), and cocamidopropyl betaine available under the trade name Mackam™ DZ (from Mcintyre Group Ltd., University Park, Ill.).

Further exemplary anionic surface active agents which may be used include fatty acid salts, including salts of oleic, ricinoleic, palmitic, and stearic acids; copra oils or hydrogenated copra oil acid, and acyl lactylates whose acyl radical contains 8 to 20 carbon atoms.

Other anionic surface active agents not particularly enumerated here may also find use in conjunction with the compounds of the present invention. The addition of one or more anionic surface active agents may be desired as it is known that this class of surface active agents, viz., surfactants, are known to be useful in facilitating the removal or stains or soils from surfaces.

Compositions according to the invention can be produced in any desired mode of mixing as it does not appear that the order of the mixing has any substantial effect upon the ultimate concentrate composition. For example, two or more of the constituents may be mixed or blended together by conventional means such as a stirrer (mechanically, electrically, magentically or manually driven) to form a partial premixture or premixtures, after which such premixture or premixtures may be added to an appropriate amount of water. Alternatively, each of the constituents in any order may be added to an amount of water under stirring after which any additional required mount of water may be subsequently added to make up a formulation within the weight ranges described above.

What is to be understood by the term "concentrate" and "concentrate composition" in this specification and claims is the pre-consumer dilution and composition of the cleaning composition which is the essentially the form of the product prepared for sale to the consumer or other end user. Such a consumer or other end user would then normally be expected to dilute the same with water to form a cleaning composition. It is to be understood however that nothing in this invention would bar its use as cleaning composition without any further dilution and it may be used in the concentrations in which it was prepared for sale. Similarly, what is to be understood by the term "cleaning compositions" are the water diluted compositions which are expected to be prepared by the consumer or other end user by mixing a measured amount of the "concentrate" with water in order to form an appropriately diluted cleaning composition which is suitable for use in cleaning applications, especially in the cleaning of hard surface cleaning applications.

As generally denoted above, the formulations according to the invention include both cleaning compositions and concentrates as outlined above which differ only in the relative proportion of water to that of the other constituents forming such formulations. While the concentrated form of the cleaning compositions find use in their original form, they are more frequently used in the formation of a cleaning composition therefrom. Such may be easily prepared by diluting measured mounts of the concentrate compositions in water by the consumer or other end user in certain weight ratios of concentrate:water, and optionally, agitating the same to ensure even distribution of the concentrate in the water. As noted, the concentrate may be used without dilution, i.e., in concentrate:water concentrations of 1:0, to extremely dilute dilutions such as 1:10,000. Desirably, the concentrate is diluted in the range of 1:0.1–1:1000, preferably in the range of 1:1–1:500 but most preferably in the range of 1:10–1:100. The actual dilution selected is in part determinable by the degree and mount of dirt and grime to be removed from a surface(s), the mount of mechanical force imparted to remove the same, as well as the observed efficacy of a particular dilution. Generally better results and faster removal is to be expected at lower relative dilutions of the concentrate in the water.

EXAMPLES

Evaluation of Cloud Points of non-ionic surfactant compositions

An evaluation of the cloud point for Neodol® 91-2.5, a nonionic surfactant composition based on linear alcohol ethoxylates was evaluated according to the following protocol. To a clean glass beaker was added 99 parts by weight of deionized water at 20° C.±0.5° C., to which was subsequently added 1 part by weight (by weight of the actives) of a Neodol® 91-2.5 composition. This test sample was stirred and the sample was immediately observed to be murky or cloudy in appearance. The sample was allowed to drop to 20° C. and it was observed to remain in its cloudy form. The surfactant composition was considered to be useful as Constituent B in the concentrate compositions according to the invention.

In a similar manner, the cloud point of Neodol® 23-6.5, a nonionic surfactant composition based on linear alcohol ethoxylates was evaluated. To a clean glass beaker was added 99 parts by weight of deionized water at 20° C.±0.5° C., to which was subsequently added 1 part by weight Coy weight of the actives) of the Neodol® 23-6.5 composition. The test sample was stirred and the sample was observed to be clear and transparent in appearance. The sample was allowed to drop to 20° C. and no change in its appearance was noted. The surfactant composition was considered not to be useful as Constituent B in the concentrate compositions according to the invention.

Preparation of Example and Comparative Formulations

Both comparative formulations according to the prior art and example formulations according to the instant invention were prepared in accordance with the following general procedure.

Into a suitably sized vessel, the following constituents were added in the sequence: water, pine oil, nonionic surfactant (cloud point 20° C.), solubilizing agent, and BTC-8358®, a quarternary ammonium compound preparation. All of the constituents were supplied at room temperature (approximately 20° C.), mixing of the constituents was achieved by the use of a magnetic stirrer. Stirring, which generally lasted from approximately 2 minutes to approximately 5 minutes continued and was maintained while the particular formulation attained uniform color and uniform clarity or translucency. Each of the formulations exhibited the following physical characteristics: transparent appearance, light to medium yellowish amber color, and an appreciable pine oil odor. The exemplary compositions were readily pourable, and retained well mixed characteristics, demonstrating excellent shelf stability.

The exact compositions of the example formulations are listed on Table 1, below wherein the values indicated for each of the formulations are indicative of weight percents of the respective constituent in the formulation.

TABLE 1

FORMULATIONS

| Formulation: | C1 | C2 | E1 |
|---|---|---|---|
| Constituent: | | | |
| Pine Oil 60 | 8 | 4 | 4 |
| Neodol 91-2.5 | — | — | 4 |
| Neodol 23-6.5 | 4 | 4 | 4 |
| BTC-8358 | 1.87 | 1.87 | 1.87 |
| isopropanol (100%) | 23.8 | 6.8 | 9.6 |
| deionized water | 62.32 | 83.32 | 76.52 |

Pine Oil 60 is a pine oil preparation available from the Glidco Organics Corp., Jacksonville, FL BTC-8358 is an alkyl benzyl dimethyl ammonium chloride (80% active) available from Stepan Chemical Co.

Neodol ® 91-2.5 is a nonionic surfactant composition based on linear alcohol ethoxylates featuring a cloud point <20° C. available from Shell Chemical Co., Houston TX.

Neodol ® 23-6.5 is nonionic surfactant composition based on linear alcohol ethoxylates featuring a cloud point >20 C. available from Shell Chemical Co., Houston TX.

With reference to Table 1, formulations designated as "C1" and "C2" are indicative of illustrative formulations which did not comprise the surface active agent having a cloud point less than 20° C., while the formulation designated as "E1" is an composition of demonstrating the blooming feature according to the present invention. Each of these formulations appeared to be translucent and varying little in color.

The determination of the the mount of a solubilizing agent, isopropyl alcohol, required in order to clarify the formulations of Table 1 provides a useful indication of the amount of required organic solvents/compatabilizers which are required in typical concentrate formulations. The weight percent of isopropyl alcohol (100%) which was added to each of the formulations is also indicated on Table 1. It is to be noted that the values indicated on Table 1 are on a 100% total weight basis of the actual weight percentages of the constituents added.

Evaluation of Example Formulations

Each of the formulations described on Table 1 was evaluated to determine the degree of light transmittance, a measure of the opacity of each of these concentrated formulations. The formulations were also evaluated in order to determine the amount of isopropyl alcohol required to clarify each of the formulations in their concentrated form.

These aqueous dilutions were prepared to evaluate the degree of light transmittance, a measure of the opacity as well as of the blooming of each of the aqueous dilutions. Certain of these aqueous dilutions were also evaluated to determine the antimicrobal efficacy of the aqueous dilution. The results of the light transmittance evaluation was determined as a percentage of light transmitted through a sample of a particular aqueous dilution wherein the transmission of a like sample of water is assigned a percentage of 100%. Testing was performed by mixing a 5 g aliquot of a particular example formulation with 315 g of tap water (with approx. 100 ppm hardness), after which the sample was mixed for 60 second and a transmittanc reading was taken using a Brinkman model PC801 dipping probe colorimiter, which was set at 620 nm to determine the light transmission of each of the samples. Samples of each formulation at 20° C. and at 40° C. were evaluated, as well as the reference (pure tap water) sample used to calibrate the colorimiter to the reference 100% light transmission sample outlined above. The resulting determined values, reported as "Blooming" in Table 2 below provide an empirical evaluation, reported in percent transmittance ("%T") of the degree of transparency of a diluted example formulation wherein 0% indicates complete opacity and 100% the transparency of a water sample as noted above. Accordingly, a lower %T of a particular aqueous dilution provided an more desirable indication of the blooming characteristic of the particular aqueous dilution.

TABLE 2

TEST RESULTS - LIGHT TRANSMITTANCE

| Formulation: | C1 | C2 | E1 |
|---|---|---|---|
| Light Transmittance: | | | |
| % T at 20° C. | 60.5 | 99.4 | 35.5 |
| % T at 40° C. | 34.2 | 97.2 | 37.1 |

As can be observed from the results on Table 2, formulation C1 required a relatively large amount of isopropyl alcohol in order to clarify its composition. Formulation C2 required a substantially smaller amount of additional is isopropyl alcohol in order to clarify its composition, however as the results of Table 4 attest, it exhibited little or no blooming behavior. Surprisingly, the formulation E1 provided the benefit of substantially reduced volatile organic content, viz., isopropyl alcohol and pine oil, but at the same time provides many of the benefits expected of typical pine oil type cleaning concentrate, i.e., good blooming characteristics. As Table 2 illustrates E1 provided blooming characteristics greatly superior to those of C1 at 20° C. and substantially similar to those of C1 at 40° C. In this manner, excellent pine oil type concentrate compositions are provided which have significantly lowered amounts of VOC and yet which provide effective detergency and good blooming characteristics. Other formulations which feature such a characteristic synergy between the respective constituents may also be similarly produced.

Preparation of Further Example Formulations

Further exemplary formulations according to the present invention which did not however include a a quaternary ammonium compound were prepared in accordance with the following general procedure.

Into a suitably sized vessel, the following constituents were added in the sequence: water, pine oil, nonionic surfactant (cloud point <20° C.), solubilizing agent, and any remaining constituents. All of the constituents were supplied at room temperature (approximately 20° C.), mixing of the constituents was achieved by the use of a magnetic stirrer. Stirring, which generally lasted from approximately 2 minutes to approximately 5 minutes continued and was maintained while the particular formulation attained uniform color and uniform clarity or translucency. Each of the formulations exhibited the following physical characteristics: transparent appearance, light to medium yellowish amber color, and an appreciable pine oil odor. The exemplary compositions were readily pourable, and retained well mixed characteristics, demonstrating excellent shelf stability.

The exact compositions of the example formulations are listed on Table 3, below wherein the values indicated for each of the formulations are indicative of weight percents of the respective constituent in the formulation.

TABLE 3

FORMULATIONS

| Formulation: | E2 | E3 |
|---|---|---|
| Constituent: | | |
| Pine Oil 60 | 4 | 4.1 |
| Neodol ® 91-2.5 | 4.1 | 4.1 |
| Neodol ® 23-6.5 | 9.0 | 6.3 |
| BTC-8358 | — | — |
| isopropanol (100%) | 15.0 | 15.0 |
| Mackam ™ DZ | — | 5.2 |
| deionized water | 62.32 | 83.32 |

Pine Oil 60 is a pine oil preparation available from the Glidco Organics Corp., Jacksonville, FL
BTC-8358 is an alkyl benzyl dimethyl ammonium chloride (80% active) available from Stepan Chemical Co.
Neodol ® 91-2.5 is a nonionic surfactant composition based on linear alcohol ethoxylates featuring a cloud point <20° C. available from Shell Chemical Co., Houston TX.
Neodol ® 23-6.5 is nonionic surfactant composition based on linear alcohol ethoxylates featuring a cloud point >20° C. available from Shell Chemical Co., Houston TX.
Mackam ™ DZ is a surfactant compositions containing cocoamidopropyl betaine With reference to Table 3, formulations designated as "E2" is an illustrative formulation which contains no quaternary ammonium compound but which exhibited the desirable blooming behaviour characteristic of the invention and of pine oil type cleaners. The formulation "E3" is a further illustrative formulations which also did not contain a quaternary ammonium compound but which contained a further surfactant compound, an amphoteric betaine compound. Each of these formulations appeared to be translucent and varying little in color.

Evaluation of Example Formulations

Each of the formulations described on Table 3 was evaluated to determine the degree of light transmittance, a measure of the opacity of each of these concentrated formulations. The formulations were also evaluated in order to determine the amount of isopropyl alcohol required to clarify each of the formulations in their concentrated form.

These aqueous dilutions were prepared to evaluate the degree of light transmittance, a measure of the opacity as well as of the blooming of each of the aqueous dilutions. Certain of these aqueous dilutions were also evaluated to determine the antimicrobal efficacy of the aqueous dilution. The results of the light transmittance evaluation was determined as a percentage of light transmitted through a sample of a particular aqueous dilution wherein the transmisson of a like sample of water is assigned a percentage of 100%. Testing was performed by mixing a 5 g aliquot of a particular example formulation with 315 g of tap water (with approx. 100 ppm hardness), after which the sample was mixed for 60 second and a transmittanc reading was taken using a Brinkman model PC801 dipping probe colorimiter, which was set at 620 nm to determine the light transmission of cash of the samples. Samples of each formulation at 20° C. and at 40° C. were evaluated, as well as the reference (pure tap water) sample used to calibrate the colorimiter to the reference 100% light transmission sample outlined above. The resulting determined values, reported as "Blooming" in Table 4 below provide an empirical evaluation, reported in percent transmittance ("%T") of the degree of transparency of a diluted example formulation wherein 0% indicates complete opacity and 100% the transparency of a water sample as noted above. Accordingly, a lower %T of a particular aqueous dilution provided an more desirable indication of the blooming characteristic of the particular aqueous dilution.

TABLE 4

TEST RESULTS - LIGHT TRANSMITTANCE

| Formulation: | E2 | E3 |
|---|---|---|
| Light Transmittance: | | |
| % T at 20° C. | 21.9 | 26.8 |
| % T at 40° C. | 28.1 | 37.9 |

As can be observed from the results on Table 4, each of formulations E2 and E3 provided excellent blooming characteristics at both 20° C. and 40° C., substantially superior than the comparative examples according to formulations C1 and C2 described above. The formulations according to E2 and E3 demonstrate excellent pine oil type concentrate compositions are provided which have significantly lowered amounts of VOC and yet which provide effective detergency and good blooming characteristics, and which do not necessarily contain quaternary ammonium compounds as a germicidal active agent. Other formulations which feature such a characteristic synergy between the respective constituents may also be similarly produced.

A further formulation according to the invention was produced in which no pine oil was present, but in which the sole blooming agent was the nonionic surfactant having a cloud point less than 20° C., and is illustrated on Table 5 following:

TABLE 5

FORMULATION

| Constituent: | weight percent |
|---|---|
| Neodol ® 91-2.5 | 5.66 |
| Neodol ® 91-8 | 5.66 |
| Dowanol ® PM | 5.66 |
| deionized water | 83.02 |

Neodol ® 91-2.5 is a nonionic surfactant composition based on linear alcohol ethoxylates featuring a cloud point <20° C. available from Shell Chemical Co., Houston TX.
Neodol ® 91-8 is a nonionic surfactant composition based on linear alcohol ethoxylates available from Shell Chemical Co., Houston TX.
Dowanol ® PM is a propylene glycol methyl ether available from Dow Chemical Co., Midland, Michigan.

Although the formulation on Table 5 did not include any pine oil, significant blooming was observed when diluted into a greater volume of water at room temperature at a ratio of formulation:water of 1:64. No pine oil was present in the composition.

We claim:

1. A liquid pine oil hard surface cleaning composition comprising per 100% wt.:

A) 0.1–4% wt. of a pine oil preparation containing at least approximately 60% wt. alpha-terpineol;

B) 0.1–10% wt. of a nonionic surfactant a with a cloud point of 20° C. or less selected from: condensation products of one or more alkylene oxide groups with an organic hydrophobic aliphatic compound, or with an organic hydrophobic alkyl aromatic compound;

C) 0.1–15% wt. of a solubilizing agent selected from the group consisting of $C_{1-8}$alcohols, and alkylene glycols;

D) water.

2. The liquid pine oil hard surface cleaning composition according to claim 1 wherein:

B) is a nonionic alkoxylated primary alcohol or alkoxylated secondary alcohol surfactant with a cloud point of 20° C. or less.

3. The liquid pine oil hard surface cleaning composition according to claim 1 which further comprises a nonessential constituent selected from: germicidal agents, viscosity modification agents, fragrances, foaming agents, detersive agents, co-surfactants, and coloring agents.

4. The liquid pine oil hard surface cleaning composition according to claim 3 wherein: the one or more optional additives comprise from 0–20% by weight based on the on the total weight of the cleaning composition.

5. The liquid pine oil hard surface cleaning composition according to claim 3 wherein the composition comprises a germically effective amount of a quarternary ammonium compound according to the formula:

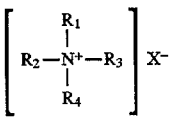

wherein;

at least one of $R_1$, $R_2$, $R_3$ and $R_4$ is selected from hydrophobic, aliphatic, aryl aliphatic or aliphatic aryl radical of from 6 to 26 carbon atoms, and any remaining $R_1$, $R_2$, $R_3$ and $R_4$ are hydrocarbons of from 1 to 12 carbon atoms, wherein any of $R_1$, $R_2$, $R_3$ and $R_4$ may be linear or branched and may include one or more ester or amide linkages; and, X is a salt-forming anionic radical.

6. The liquid pine oil hard surface cleaning composition according to claim 5 wherein the compostion comprises a quarternary ammonium compound according to the formula:

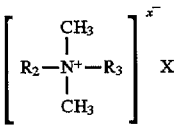

wherein $R_2$ and $R_3$ are the same or different $C_8$–$C_{12}$alkyl, or $R_2$ is $C_{12-16}$alkyl and $R_3$ is benzyl, and the X is a halide or methosulfate.

7. The liquid pine oil hard surface cleaning composition according to 3 wherein the compostion comprises a germicidally effective amount of a quarternary ammonium compound selected from cetyl trimethyl ammonium bromide, alkyl aryl ammonium halides, N-alkyl pyridinium halides, octyl phenoxy ethoxy ethyl dimethyl benzyl ammonium chloride, N-(laurylcocoaminoformylmethyl)-pyridinium chloride, and quarternary ammonium compounds which includes a hydrophobic radical which includes a substituted aromatic nucleus.

8. A liquid pine oil cleaning composition according to claim 1 consisting essentially of:

A) 0.1–4% wt. of a pine oil preparation containing at least approximately 60% wt. alpha-terpineol;

B) 0.1–10% wt. of a nonionic alkoxylated primary alcohol or alkoxylated secondary alcohol surfactant with a cloud point of 20° C. or less;

C) 0.1–15% wt. of a solubilizing agent selected from the group consisting of $C_{1-8}$alcohols, and alkylene glycols;

D) water; and,

E) to 20% wt. of one or more constituents selected from germicidal agents, viscosity modification agents, fragrances, foaming agents, detersive agents, co-surfactants, and coloring agents.

9. A blooming type, aqueous hard surface cleaning composition comprising per 100% wt.:

A) 0.1–4% wt. of a pine oil preparation containing at least approximately 60% wt. alpha-terpineol;

B) 0.1–100% wt. of a nonionic surfactant with a cloud point of 20° C. or selected from: condensation products of one or more alkylene oxide groups with an organic hydrophobic aliphatic compound, or with an organic hydrophobic alkyl aromatic compound;

C) 0.1–15% wt. of a solubilizing agent selected from the group consisting of $C_{1-8}$alcohols, and alkylene glycols:

D) water;

E) 0–20% wt. of one or more constituents selected from germicidal agents, viscosity modification agents, fragrances, foaming agents, detersive agent, co-surfactants, and coloring agents.

10. An aqueous cleaning composition according to claim I comprising the liquid pine oil cleaning compositon according to claim 1 dispersed in water in a weight ratio of composition to water of from 1:0.01 to 1:1000.

11. A process for cleaning a hard surface requiring such treatment which process includes the step of:

applying a cleaning composition according to claim 1 in an amount effective for providing a cleaning treatment.

* * * * *

UNITED STATES PATENT AND TRADEMARK OFFICE

CERTIFICATE OF CORRECTION

PATENT NO. : 5,728,672
DATED : March 17, 1998
INVENTOR(S) : Alan F. Richter

It is certified that error appears in the above-identified patent and that said Letters Patent is hereby corrected as shown below:

In column 14, line 61, after the word "surfactant" delete "a".

In column 15, lines 39-44, delete the chemical compound structure:

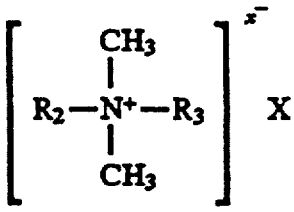

and insert the following chemical compound structure:

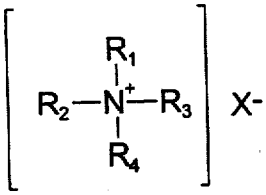

UNITED STATES PATENT AND TRADEMARK OFFICE

CERTIFICATE OF CORRECTION

PATENT NO. : 5,728,672
DATED : March 17, 1998
INVENTOR(S) : Alan F. Richter

It is certified that error appears in the above-identified patent and that said Letters Patent is hereby corrected as shown below:

In column 15, line 49, after the words "according to" insert the word --claim--.

In column 16, line 36, after the word "water;", insert --and--.

In column 16, line 39, after the word "detersive" delete "agent" and insert --agents--.

Signed and Sealed this

Twenty-sixth Day of May, 1998

Bruce Lehman

*Attest:*

BRUCE LEHMAN

*Attesting Officer*

*Commissioner of Patents and Trademarks*